US012544641B2

(12) United States Patent
Quarton

(10) Patent No.: US 12,544,641 B2
(45) Date of Patent: Feb. 10, 2026

(54) DYNAMIC EXERCISE SYSTEM

(71) Applicant: STRIKE MOTION LIMITED, London (GB)

(72) Inventor: Robert Quarton, London (GB)

(73) Assignee: Strike Motion Limited, London (GB)

( * ) Notice: Subject to any disclaimer, the term of this patent is extended or adjusted under 35 U.S.C. 154(b) by 216 days.

(21) Appl. No.: 18/250,014

(22) PCT Filed: Nov. 3, 2021

(86) PCT No.: PCT/GB2021/052851
§ 371 (c)(1),
(2) Date: Apr. 21, 2023

(87) PCT Pub. No.: WO2022/096876
PCT Pub. Date: May 12, 2022

(65) Prior Publication Data

US 2023/0398422 A1 Dec. 14, 2023

(30) Foreign Application Priority Data

Nov. 3, 2020 (GB) ..... 2017422

(51) Int. Cl.
*A63B 69/24* (2006.01)
*A63B 69/20* (2006.01)

(52) U.S. Cl.
CPC ..... *A63B 69/244* (2022.08); *A63B 69/305* (2022.08)

(58) Field of Classification Search
CPC ..... A63B 69/244; A63B 69/305; A63B 69/20; A63B 69/22; A63B 69/222; A63B 69/24;
(Continued)

(56) References Cited

U.S. PATENT DOCUMENTS 7,121,989 B2 10/2006 Kerry
7,857,734 B2 12/2010 Miller et al.
(Continued)

FOREIGN PATENT DOCUMENTS

CN 208287447 12/2018
WO WO2019148255 8/2019

OTHER PUBLICATIONS

PCT Search Report and Written Opinion prepared for PCT Application No. PCT/GB2021/052851, completed Feb. 2, 2022.

*Primary Examiner* — Loan B Jimenez
(74) *Attorney, Agent, or Firm* — Barnes & Thornburg LLP

(57) ABSTRACT

This present disclosure relates to a dynamic exercise system to permit a sports training implement to move smoothly to any point within a defined area, such that the training implement moves in reaction to applied forces, and such that torque, including those applied externally to the training implement and any within or between any elements of the mechanism, are dissipated without prejudice to the smooth linear motion of the implement. In particular, a dynamic exercise system is provided which comprises: a first rigid member comprising a first trolley; a second rigid member comprising a second trolley, wherein the first trolley and second trolley are configured to be movable linearly along and rotatable about the longitudinal axis of the respective first and second members; a third rigid member attached at a first end to the first trolley and at a second end to the second trolley via respective first and second flexible connectors; a third trolley mounted on the third rigid member configured to be movable linearly along the third rigid member, the third trolley comprising means for connection to an exercise device.

17 Claims, 4 Drawing Sheets

(58) Field of Classification Search
CPC ..... A63B 69/28; A63B 69/30; F16M 13/027; A47G 1/16; F21V 21/04
See application file for complete search history.

(56) References Cited

U.S. PATENT DOCUMENTS

| | | | | |
|---|---|---|---|---|
| 2004/0242389 | A1* | 12/2004 | Kerry | A63B 69/0057 482/140 |
| 2006/0058164 | A1* | 3/2006 | Miller | A63B 69/244 482/83 |
| 2012/0283047 | A1* | 11/2012 | DeTroia | A63B 69/244 473/441 |

* cited by examiner

DYNAMIC EXERCISE SYSTEM

CROSS REFERENCE TO RELATED APPLICATIONS

This application is the U.S. national phase of PCT/GB2021/052851, filed on Nov. 3, 2021, which claims the benefit of United Kingdom Patent Application Number 2017422.3, filed on Nov. 3, 2020, the entire disclosures of both of which are hereby incorporated by reference herein.

FIELD OF THE DISCLOSURE

The present disclosure generally relates to a dynamic exercise system for combat sports, and more particularly to a dynamic exercise system to allow a punch bag or other training implement to move smoothly in a defined area in response to external forces.

BACKGROUND

Exercise systems for supporting or suspending punch bags or other training implements are known in the art. Generally, punch bags or other training implements are used for training and exercise that relate to mixed martial arts, traditional martial arts, and boxing, and aid in the development of speed, agility, strength, timing, and accuracy of striking techniques desirable in those activities.

When supported from the floor or suspended from a ceiling, a conventional exercise system may hold a punch bag or other training implement at a predetermined, fixed location. The bag may respond to external input by rotating around its mounting point, but this mounting point remains stationary. Such a system provides a limited user experience in the sense that the movement of the training implement is entirely predictable, and the user is not challenged to respond to its movement.

More advanced exercise systems seek to allow a training implement to move smoothly in a wider defined area; that is, the mounting of the implement is not fixed. This can offer several advantages over a conventional system, including a more intense user experience that includes technique development and increased cardiovascular conditioning. This movement may be induced by user strikes or any internal mechanism may be configured such that its motion is unpredictable.

A problem which may occur in more advanced systems relates to whether the training implement moves smoothly within the defined area. Existing systems of this type either fail to achieve smooth motion, or they achieve some degree of smooth motion but with a highly complex design. A significant factor contributing to the challenge of designing such a system may relate to maintaining smooth motion of the training implement while responding to the potentially significant forces applied to the implement by the user in normal operation. The timing, direction and magnitude of these forces are effectively random. This could influence the design complexity, or the failure to achieve the desired smooth motion of the training implement. These dynamic forces may induce torque on the mounting of the training implement itself or induce internal torque on the moving parts of the system. If not properly accounted for in the design, this torque may be applied to the running mechanisms which permit the training implement to move, which can cause the mechanism to become seized or jammed or produce significant stress on that mechanism, affecting its longevity. Both external forces and applied or induced torque need to be efficiently dissipated, to ensure the smooth movement of the punch bag or other training implement and to minimise any stress or wear on the advanced exercise system. A simple design that allows a training implement to move smoothly within the defined area, will improve manufacturing assembly, support ease of installation and reduce user maintenance and servicing requirements.

Therefore, a need exists for an exercise system, based upon a simple design that efficiently dissipates torque such that it impacts minimally on the smooth motion of the training implement. This may be achieved either by ensuring that torque is dissipated without being applied to the running mechanism, or by designing a running mechanism that is unaffected by torque, or a combination of these. This will ensure that the mechanism provides smooth motion of the training implement within the defined area, in response to the forces applied by the user during normal operation when striking a training implement.

It is, therefore, the object of the present disclosure to provide a dynamic exercise system to permit a sports training implement, such as a punch bag, to move smoothly to any point within a defined area, such that the training implement moves in reaction to applied forces, and such that torque, including those applied externally to the training implement and any within or between any elements of the mechanism, are dissipated with minimal impedance to the linear motion of the implement.

SUMMARY OF DISCLOSURE

A dynamic exercise system is provided which comprises a first rigid member comprising a first trolley, a second rigid member comprising a second trolley, wherein the first trolley and second trolley are configured to be movable linearly along and rotatable about the longitudinal axis of the respective first and second members, a third rigid member attached at a first end to the first trolley and at a second end to the second trolley via respective first and second flexible connectors, a third trolley mounted on the third rigid member configured to be movable linearly along the third rigid member, the third trolley comprising means for connection to an exercise device.

The dynamic exercise system of the present disclosure allows for an exercise device, such as a punch bag, to be suspended from a pair of supports and movable with an area bounded by the support. As used herein, the term "exercise device" is used interchangeably with the term "training implement". All of the elements can move somewhat independently, because the first and second trolleys can move both along and around the supports, and because the third member, from which the exercise device hangs, is flexibly connected to the trolleys. This arrangement reduces the risk of the components of the exercise system seizing or fouling such that movement becomes impeded. As such, even when one trolley is accelerated faster than the other causing the third rigid member to twist relative to the first and second rigid members, or when a component of the applied force is applied perpendicularly to the longitudinal axis of its rigid member, the exercise device can move smoothly, and in this way simulates interaction with a human opponent.

Optionally, the first and second rigid members are substantially parallel. A purpose of the exercise system is to allow the punch-bag to move freely around an area of travel. This is achieved in part by the ability for the system to flex such that it is not critical to ensure that the third rigid member remains perpendicular to the first and second rigid members. In particular, by enabling the first trolley and second trolley to rotate about the longitudinal axis of the respective first and second rigid members, and misalignment of the third rigid member can be tolerated, thus enabling the punch bag to move smoothly within the area. It is noted that the alignment of the trolleys on the rigid members is not influenced directly by movement of the third rigid member, because of the flexible connectors mounting the third rigid member to the first and second trolleys. By setting the first and second rigid members parallel, the amount of flex in the system may be maintained throughout the area.

The third rigid member may have a length substantially equal to the distance between the first rigid member and the second rigid member. Alternatively, the third rigid member may have a length which is greater than the distance between the first rigid member and the second rigid member.

Optionally the first, second and third rigid members are tubular. By having the rigid members, on which the trolleys move, tubular, the trolleys are more easily able to rotate around the members.

Optionally each trolley comprises a rigid supporting frame and at least one pulley wheel disposed within the frame. By providing a frame and pulley wheel arrangement the trolley can move along the rigid members with ease, and is prevented from slipping off the rigid member. The pulley wheel of each trolley is connected to the rigid supporting frame via an axle, and the pulley wheel is connected to the axle via a bearing. There may be more than one pulley wheel, such as an arrangement with one or more pulley wheels disposed underneath the rigid member and one or more pulley wheels disposed above the rigid member. This can further secure the trolley on the rigid member whilst still allowing rotation and linear movement. In this way each pulley wheel of each trolley is configured to engage with a respective first, second, or third rigid member.

Optionally an engaging surface of the or each pulley wheel of each trolley has a substantially arcuate profile having a radius of curvature larger than the radius of the respective rigid member. The interface between the pulley wheel and the rigid member allows the pulley wheel to rotate on the member, however by reducing the area of contact, by providing the profile of the pulley wheel with a radius of curvature larger than the radius of the respective rigid member, the friction is reduced whilst still maintaining the pulley wheel on the rigid member by the sides of the pulley wheel. Alternatively, the engaging surface of the or each pulley wheel of each trolley has a profile which substantially matches the profile of the respective rigid member, which prevents rotation of the pulley wheel about the rigid member in a plane parallel to the longitudinal axis, thus reducing the chance for the trolley to become seized.

Optionally the flexible connector comprises a first hook coupled to the third rigid member, the respective first trolley and second trolley comprising means for receiving said first hook such that the third rigid member is rotatable with respect to the respective trolley. Rotation of the connector allows for the third rigid member to move independently of the trolley. Additionally, the means for receiving said first hook may be formed as a second hook interlinkable with the first hook. This allows the third rigid member to swing beneath the trolleys, and creates a simple mechanism by which all elements of the system are capable of some degree of independent movement. Relative rotation between elements of the system thereby does not disrupt the alignment of any pulley wheel with the corresponding rigid member.

Optionally the means for connection to an exercise device comprises a connection hook which is rotatable with respect to the third trolley. Using a similar mechanism on the third trolley allows for a simpler construction and a reduction in manufacturing costs and complexity, whilst also allowing greater movement of the exercise device even with respect to the trolley from which it is suspended. The skilled person would understand that the above-described flexible connectors may not be comprised of hooks, and may instead comprise springs, ropes, chains, rubber elements, or any other suitable device for flexibly connecting the third rigid member to the first and second trolleys and/or for connecting the exercise device to the third trolley.

Optionally the dynamic exercise system comprises resilient restraining means configured to moderate movement of the exercise device. An object of the present disclosure is to control, or moderate, movement of the exercise device. In an example, the resilient restraining means comprises at least one resilient member connected at a first end to the exercise device and at the second end to a fixed point relative to the first rigid member and the second rigid member. This resilient member can be elastic or another similarly resilient means, such as a coil spring. In one example, the resilient member is formed of an elastic cord, such as a bungee cord. The resilient member(s) may ensure that the exercise device returns to its original location, and also may introduce an element of randomness to the movement of the exercise device, depending on where the resilient members are attached. Where there is a plurality of resilient members, each can be fixed at a first end to the exercise device and at a second end to one of at least a first and second fixed point, the first and second fixed points being at different locations. This allows for movement to be moderated in a number of directions, and in some cases the resilience of at least one of the plurality of resilient members is different to the resistance of at least one other of the plurality of resilient members, which allows for different moderation of movement of the exercise device to be applied depending on the direction it is moved by the user.

Optionally the first and second rigid members are configured for connection to a rigid support frame. This provides a means for the exercise device to be suspended, preventing the user from needing to attach the support frame to a fixture of a property or building and having to ensure alignment of the various elements when installed.

The exercise device, or training implement, can be any one of a punchbag, a maize bag, or a grappling dummy. Of course, the skilled person will understand that this is not an exhaustive list, and any such exercise device suitable for use with the system may be used.

According to a further aspect of the present disclosure, there is provided a method whereby a punch bag or other training implement is enabled to move smoothly within a defined training area, and which is capable of dissipating applied and induced torque such that smooth motion is maintained despite any forces applied to the training implement. Succinctly, the linear motion of the training implement is decoupled from torque applied to it, and torque induced on any part of the system.

The method consists of a supporting structure and a mobile subsystem capable of smooth motion with respect to the structure. The mobile subsystem providing facility for the mounting of a training implement, such that the implement is mobile and moves within the area in reaction to applied forces, and such that torque, including that applied externally to the implement and any within or between the subsystem/support, are dissipated while permitting the implement to move smoothly within the area. A novel aspect of this disclosure is that the mechanism by which linear motion is achieved is not disrupted by torque; it is designed to dissipate it According to a further aspect of the present disclosure, the dynamic exercise system permits a sports training implement to move smoothly to any point within a defined area, the system comprising a supporting structure; a mobile subsystem capable of smooth motion with respect to the structure; the mobile subsystem providing facility for the mounting of a training implement, such that the implement is mobile and moves within the area in reaction to applied forces, and such that torque, including that applied externally to the implement and any within or between the subsystem/support, are dissipated while permitting the implement to move smoothly within the area.

According to a further aspect of the present disclosure, the mobile subsystem includes at least a first mobile element; a second mobile element; one or more motive subsystems to enable relative motion between any two of the support, the first mobile element and the second mobile element, the motion characterised in that the smooth linear motion of the mobile elements enables applied or induced torque to be dissipated; the dissipation may be achieved by individual elements of the motive subsystem or by the co-operative action of multiple such elements, or a combination of these.

According to a further aspect of the present disclosure, the motive subsystems consist of first motive subsystem to attach the first mobile element to the support and permit relative motion between the two; second motive subsystem to attach the second mobile element to the first mobile element and permit relative motion between the two, and to provide the mounting for the training implement, the relative motion admitted being so as to permit the second mobile element to move to any point in a defined area.

According to a further aspect of the present disclosure, the supporting structure consists of two or more rigid members.

According to a further aspect of the present disclosure, the first mobile element moves along a first axis.

According to a further aspect of the present disclosure, the second mobile element moves along a second, distinct axis, independently of the motion of the first mobile element along the first axis, whereby the second mobile element can move to any point in the defined area by motion of the first and second mobile elements along their respective axes, such that all torque applied to the implement in a plane perpendicular to the second axis is dissipated without prejudice to the linear motion of the second mobile element along the axis.

According to a further aspect of the present disclosure, the supporting members are straight and parallel, whereby the defined area is rectangular.

According to a further aspect of the present disclosure, the second mobile element includes a mounting mechanism for attaching the training implement, with the property that the implement is capable of freely rotating about an axis perpendicular to the area.

According to a further aspect of the present disclosure, the first motive subsystem attaches the first mobile element at a first end to one member of the supporting structure, and at a second, opposite end to the remaining member.

According to a further aspect of the present disclosure, the first motive subsystem includes two trolley subsystems, one attaching each end of the first mobile element to a member of the support, which permit linear motion along the supports, each being capable of rotation about an axis collinear with the extent of the support, and correspondingly capable of dissipating torque applied about the axis.

According to a further aspect of the present disclosure, the second motive subsystem consists of a single trolley subsystem of the kind in described above, whereby the second motive subsystem is capable of rotation about an axis collinear with the extent of the first mobile element, and is correspondingly capable of dissipating torque applied about the axis.

According to a further aspect of the present disclosure, the trolley subsystems couple to the first mobile element such that they are capable of some degree of independent linear and rotational motion, whereby any torque applied parallel to the supporting members or to the first mobile element perpendicular to the area may be dissipated with minimal torque applied on that part of the subsystem responsible for linear motion, thereby with minimal impedance to that motion.

According to a further aspect of the present disclosure, the supports, and the first mobile element, are of at least partially curved cross-sections.

According to a further aspect of the present disclosure, the trolley subsystems consist of a rigid supporting frame; at least one pulley wheel free to rotate with respect to the frame; a coupling mechanism configured such that any attached object may move and rotate freely with respect to the frame in a hemisphere or a subset of one.

According to a further aspect of the present disclosure, the curvature of the profile of the pulley wheels matches or is less curved than that of the cross-section of the supporting member upon which they sit, whereby the trolley subsystems may rotate about the axis of the member without compromising the alignment between the pulley wheels and the support required for them to rotate and enable linear motion; thereby, torque exerted upon the subsystem is dissipated through angular acceleration about the member, with minimal impedance to linear motion along the member.

The dynamic exercise device will now be described in a more detailed manner, by way of example only, with reference to the accompanying figures, which illustrate various features which may be present in an embodiment of the device. Some details will be omitted for the sake of clarity.

FIGURES

DETAILED DESCRIPTION

Figure 1:
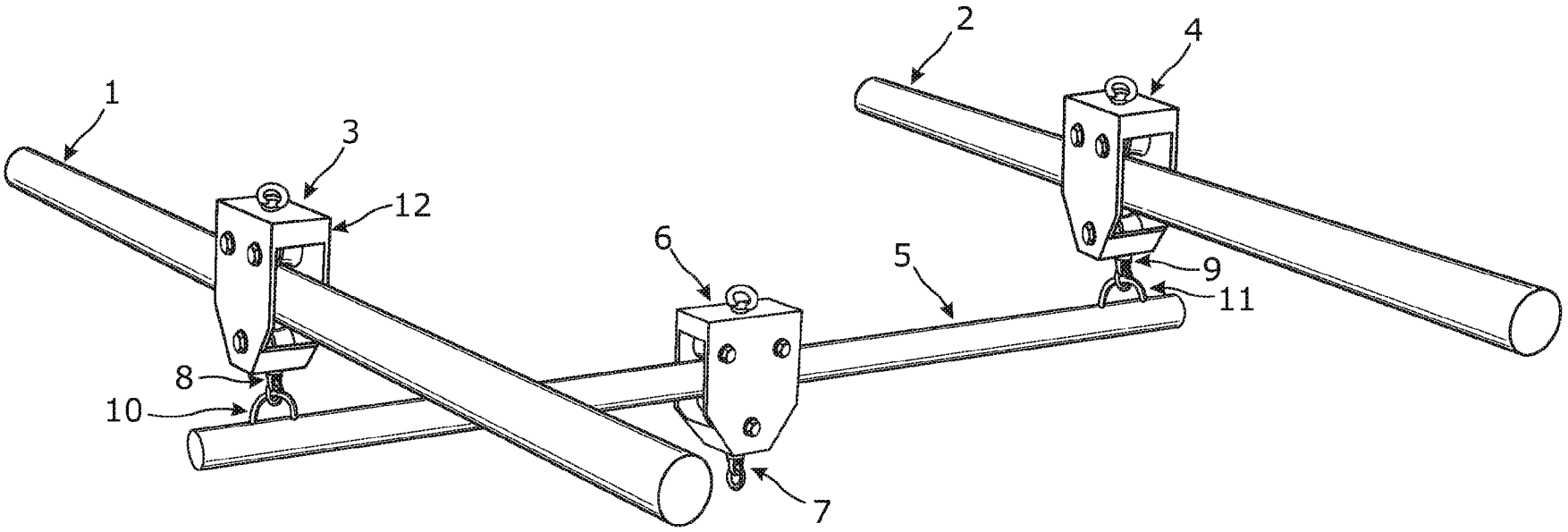
FIG. 1 illustrates a dynamic exercise system according to an aspect of the disclosure.

Referring to FIG. 1, there are shown two parallel, rigid, members 1 and 2 (which may or may not be mounted to a rigid free-standing structure, or to a ceiling), upon which run trolleys 3 and 4, respectively. In this embodiment the members 1 and 2 are made of metal, but it is understood that other materials may be used. The members may be tubular to engage with a pulley wheel, however other profiles are envisaged which match a pulley wheel profile.

The trolleys 3 and 4 are free to move linearly along, and rotate about the axes of, the members 1 and 2. The members 1 and 2 may or may not be sleeved in another material for any purpose, including that of reducing resistance to either or both of the linear and rotational motions of the trolleys 3 and 4, or for the purpose of reducing noise as the trolleys 3 and 4 move.

The trolleys 3 and 4 attach to either end of a further rigid, tubular member 5 of substantially similar characteristics to members 1 and 2 through motive mechanisms, such as hooks 8 and 9 not illustrated in detail, but which have the capacity for rotational motion with respect to the trolleys 3 and 4. The attachment of the member 5 to the trolleys 3 and 4 is such that trolleys 3 and 4 are capable of some degree of independent motion on their respective members. In this embodiment, the mechanisms 8 and 9 interlink with U-shaped hooks 10 and 11, which attach to either end of the member 5 in a manner not shown. This permits the member 5 to swing in a plane perpendicular to its extent. A further trolley 6 of substantially similar characteristics to trolleys 3 and 4 is free to move linearly and rotationally on the member 5. The linear motion of trolleys 3 and 4 along the members 1 and 2, respectively, enables the member 5 to travel linearly. The capacity of trolleys 3 and 4 for independent motion (enabled by the non-rigidity of the attachment mechanisms 8 and 9) means that the member 5 is capable of rotation in a plane parallel with the floor.

In this embodiment the trolleys 3,4,6 have face plates of the type 12 on both ends of the body. Any device (not shown) may be secured to the face plate 12 in any manner to cause the trolley 3,4,6 to rebound when it reaches the end of its respective member 1,2,5. This device could take the form, for example, of a spring, piston, or rubber buffer.

Figure 2:
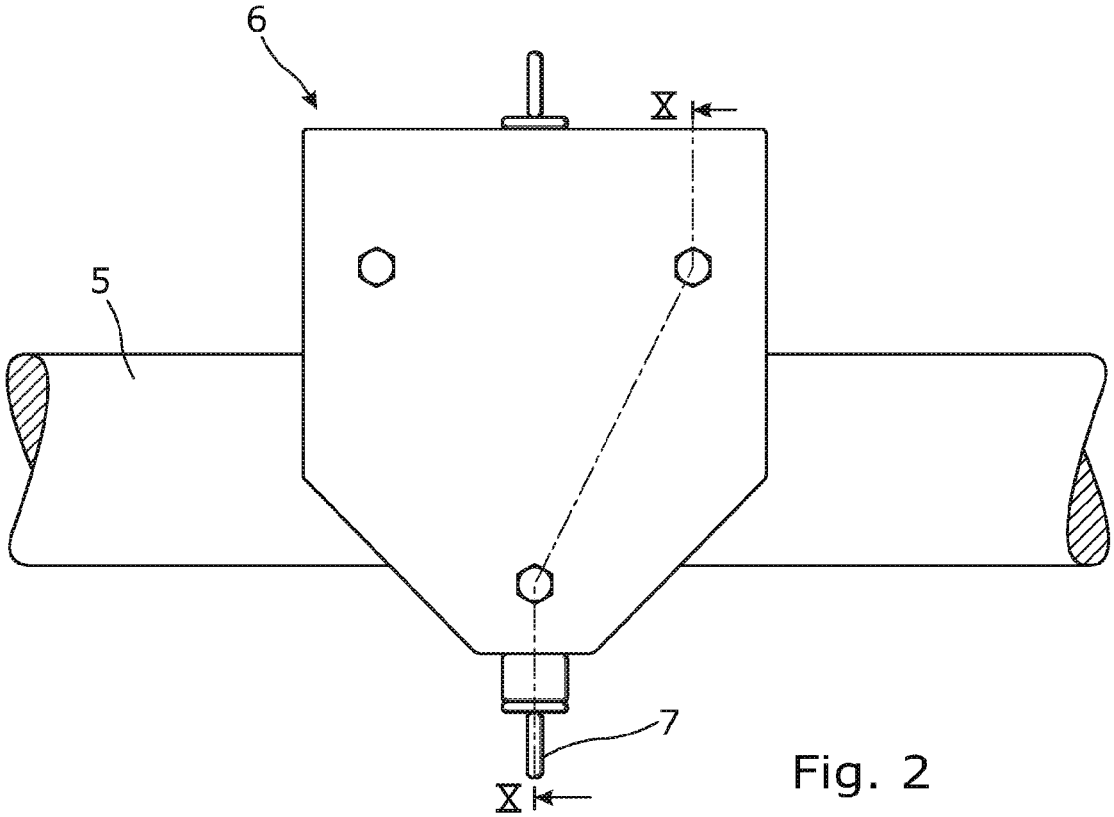
FIG. 2 illustrates an alternative perspective of a member and trolley as shown in FIG. 1.

In this embodiment the attachment 7 on trolley 6 provides a mounting system for attaching any training implement to the trolley 6, in such a way that the training implement may rotate about an axis perpendicular to the floor. This is shown in greater detail in FIG. 2.

Figure 3:
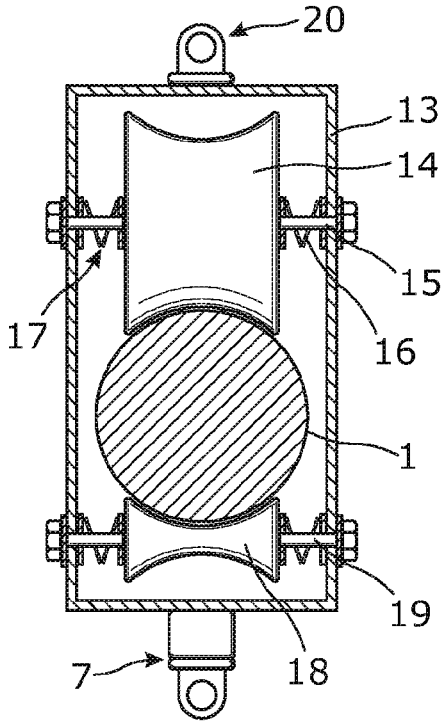
FIG. 3 shows a cross section of the member and trolley shown in FIG. 2.

Referring to FIG. 3, illustrating a trolley of the kind 3,4,6, a metal housing 13 contains one or more pulley wheel(s) 14, with the radius of curvature of the profile of the pulley wheels being larger than or matching that of the cross-section of the supporting members 1, 2 and 5 respectively. The pulley wheel(s) 14 is constructed of a material with sufficiently low coefficient of friction that it may rotate in about the member upon which it sits with minimal impedance. In this embodiment the housing 13 is machined steel, but it is understood that other materials and construction techniques may be used. The pulley wheel(s) 14 rotate about an axle 15, which is secured to the housing 13 in a manner not detailed, but could include both ends of the axle being threaded and bolted on the outside of the housing 13. The free rotation of the pulley wheel(s) 14 is achieved in a manner not shown and/or by the use of a rotary bearing attaching the axle 15 to the pulley wheel(s) 14. This permits the trolleys 3, 4 and 6 to move smoothly along the members 1, 2 and 5, respectively. In this embodiment, the pulley wheel(s) 14 are maintained in a position central to the housing 13 by the use of spring washers 16 and 17, though it is understood that other means may be used. The housing 13 may contain at least one further pulley wheel 18 mounted to the housing 13 such that a member 1,2,5 may fit between the pulley wheels 14 and 18. The pulley wheel(s) 18 are mounted to the housing 13 by means of an axle 19. In this embodiment the axle 19 is mounted using the same mechanism as does axle 15, and the pulley wheel 18 is maintained centrally in the housing 13 by the same mechanism (not shown) as is pulley wheel(s) 14, though it is understood that different approaches not illustrated may be used. Zero or more eyelets 20 may be attached to the housing 13 of any trolley 3,4,6 in a manner not shown for any purpose including the attachment of zero or more elasticated cables (not shown in FIG. 1) which may be secured at the other end in any manner, including externally. In this embodiment, a single eyelet 20 is secured to the top of the housing 13.

In this embodiment, the trolleys 3,4,6 are alike, however it is understood that they may differ in any respect, for instance the pulley wheel(s) may have profiles of different curvatures to account for the members 1,2,5 having different diameters.

Figure 4:
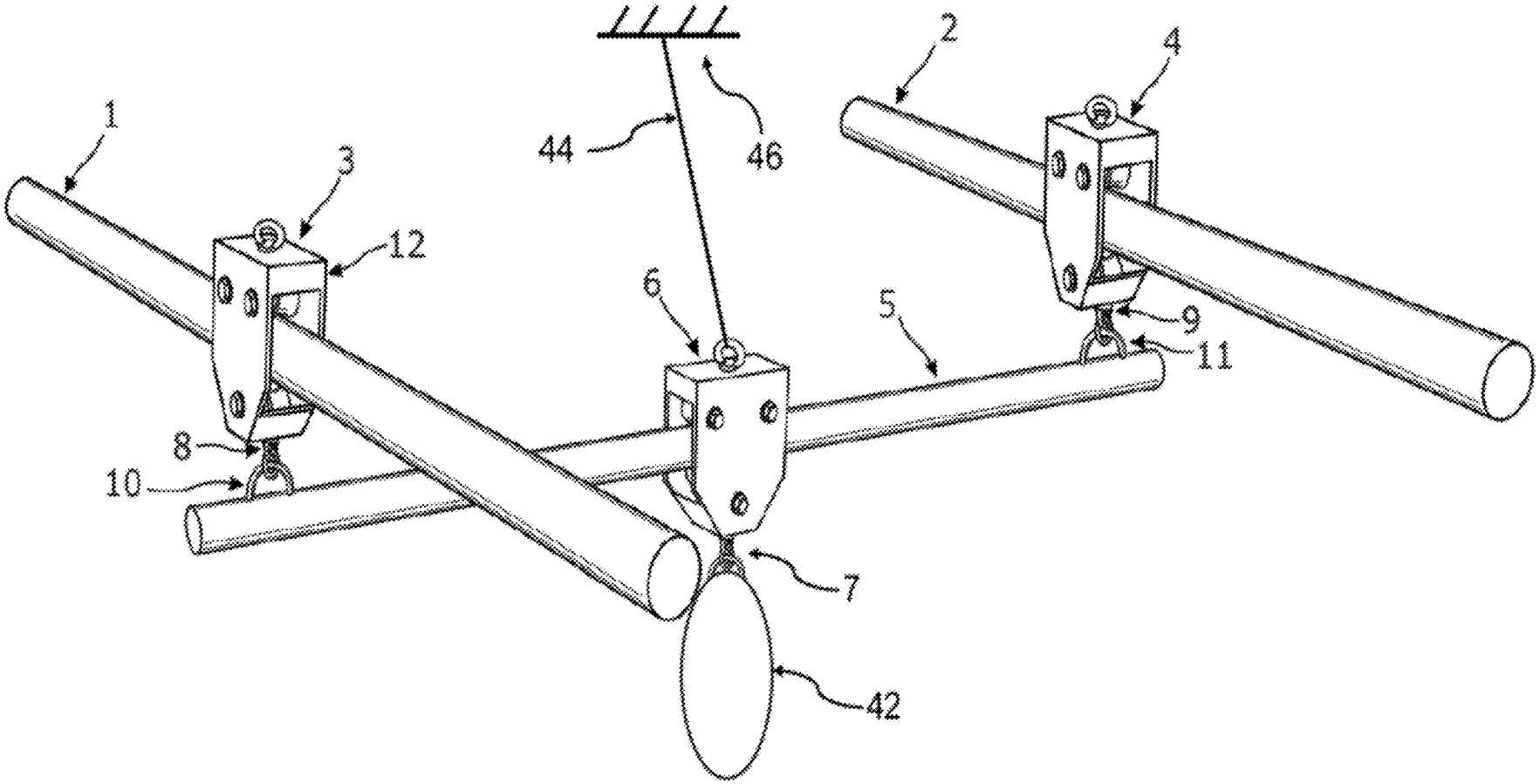
FIG. 4 illustrates a further example of a dynamic exercise system according to the disclosure.

FIG. 4 shows a further example of the exercise system. In this example, the exercise system shown in FIG. 1 has been adapted. The training implement attached to the attachment 7 is an exercise device 42. A resilient restraining member 44 is attached at a first end to the trolley 6 and at a second end to a fixed point 46 relative to the first rigid member 1 and second rigid member 2. The resilient restraining member 44 may be a bungee cord attached to a ceiling, or any other resilient restraining member as described herein.

The invention claimed is:

1. A dynamic exercise system comprising:

a first rigid member comprising a first trolley;

a second rigid member comprising a second trolley, wherein the first trolley and second trolley are configured to be movable linearly along and rotatable about the longitudinal axis of the respective first and second rigid members;

a third rigid member attached at a first end to the first trolley and at a second end to the second trolley via respective first and second flexible connectors;

a third trolley mounted on the third rigid member configured to be movable linearly along the third rigid member, the third trolley comprising means for connection to an exercise device.

2. The dynamic exercise system of claim 1, wherein each of the first, second, and third trolleys comprises a rigid supporting frame and at least one pulley wheel disposed within the frame.

3. The dynamic system of claim 2 wherein each of the pulley wheels of each trolley is configured to engage with a respective one of the first, second or third rigid member.

4. The dynamic exercise system of claim 3 wherein an engaging surface of each of the pulley wheels of each of the first, second, and third trolleys has an arcuate profile having a radius of curvature larger than the radius of the respective first, second, or third rigid member.

5. The dynamic exercise system of claim 3 wherein an engaging surface of each of the pulley wheels of each of the first, second, and A third trolleys has a profile which matches the profile of the respective first, second, or third rigid member.

6. The dynamic exercise system of claim 1, further comprising resilient restraining means configured to moderate movement of the exercise device relative to the first rigid member and the second rigid member.

7. The dynamic exercise system of claim 6 wherein the resilient restraining means comprises at least one resilient member connected at a first end to the exercise device and at the second end to a fixed point relative to the first rigid member and the second rigid member.

8. The dynamic exercise device of claim 7 wherein the at least one resilient member further comprises a plurality of resilient members, each fixed at a first end to the exercise device and at a second end to one of at least a first and second fixed point, wherein the first and second fixed points are at different locations.

9. The dynamic exercise device of claim 8 wherein each of the plurality of resilient members has a defined resilience, and wherein the resilience of at least one of the plurality of resilient members is different to the resilience of at least one other of the plurality of resilient members.

10. The dynamic exercise system of claim 1, wherein the first and second flexible each comprises a first hook coupled to the third rigid member, the respective first trolley and second trolley comprising means for receiving said respective first hooks such that the third rigid member is rotatable with respect to the respective first and second trolley.

11. The dynamic exercise system of claim 10 wherein the means for receiving said first hook is formed as a second hook interlinkable with the first hook.

12. The dynamic exercise system of claim 1, wherein the first and second rigid members are parallel.

13. The dynamic exercise system of claim 1, wherein the first, second and third rigid members are tubular.

14. The dynamic exercise system of claim 1, wherein the third trolley is configured to be rotatable about the longitudinal axis of the third rigid member.

15. The dynamic exercise system of claim 1, wherein the means for connection to an exercise device comprises a connection hook which is rotatable with respect to the third trolley.

16. The dynamic exercise system of claim 1, wherein the first and second rigid members are configured for connection to a rigid support frame.

17. The dynamic exercise system of claim 1, wherein the exercise device is one of a punchbag, a maize bag, or a grappling dummy.

* * * * *